United States Patent [19]

Hofmann et al.

[11] 3,986,864

[45] Oct. 19, 1976

[54] METHOD FOR BRIQUETTE BREAKING

[75] Inventors: Gottfried Hofmann, Lutzelfluh-Goldbach, Switzerland; Frank Kennedy, Mount Lebanon Township, Allegheny County, Pa.

[73] Assignee: United States Steel Corporation, Pittsburgh, Pa.

[22] Filed: Mar. 13, 1975

[21] Appl. No.: 558,195

Related U.S. Application Data

[62] Division of Ser. No. 240,085, March 31, 1972, Pat. No. 3,897,183, Division of Ser. No. 240,085, March 31, 1972, Pat. No. 3,897,183.

[52] U.S. Cl. ..... 75/3; 264/118

[51] Int. Cl.[2] ..... C22B 1/08

[58] Field of Search ..... 75/3–5; 264/117, 118, 122

[56] References Cited

UNITED STATES PATENTS

| | | | |
|---|---|---|---|
| 3,291,593 | 12/1966 | Graham | 75/3 |
| 3,489,550 | 1/1970 | Anderson | 75/5 |

*Primary Examiner*—Peter D. Rosenberg
*Attorney, Agent, or Firm*—John E. Callaghan

[57] ABSTRACT

Loose material such as iron ore may be formed into a briquette sheet and separated into their individual briquettes by applying impact forces on opposite sides of the briquette sheet and to next adjacent briquettes.

7 Claims, 4 Drawing Figures

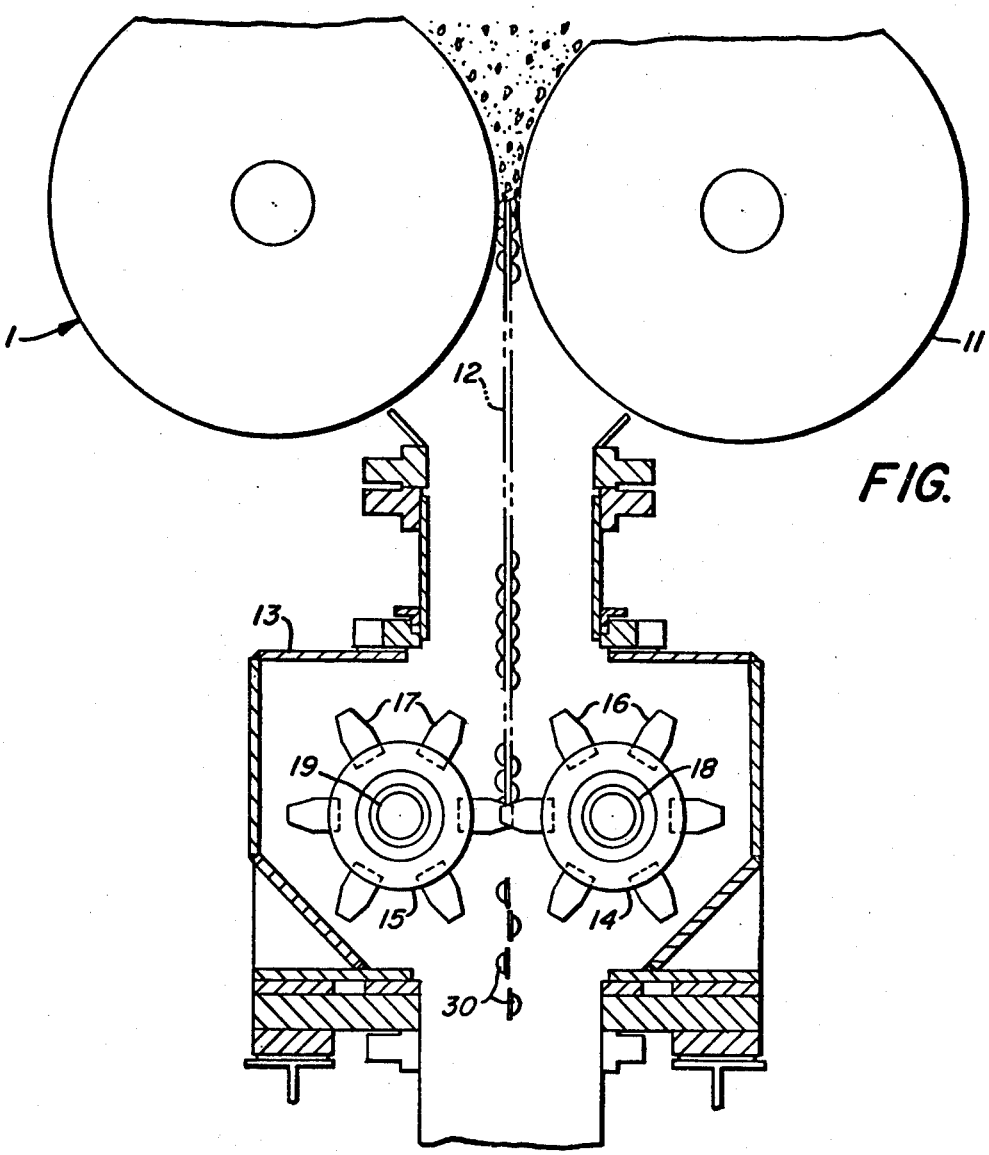
FIG. 1
FIG. 3
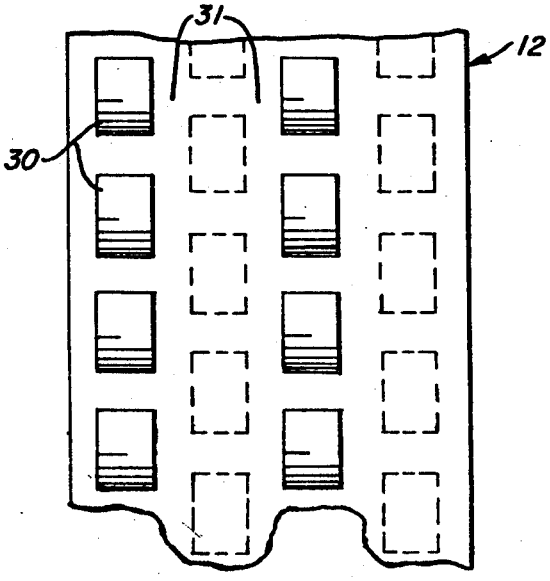
FIG. 4
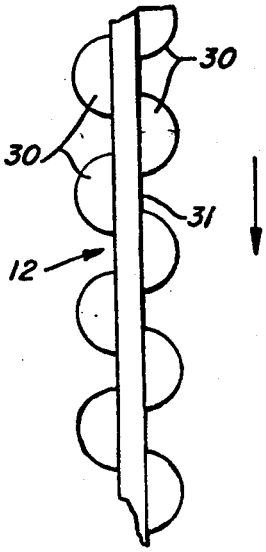

METHOD FOR BRIQUETTE BREAKING

This is a division of application Ser. No. 240,085, filed Mar. 31, 1972, now U.S. Pat. No. 3,897,185.

BACKGROUND OF THE INVENTION

Agglomerating of loose materials into pillows or D-shaped lumps has been done by means of roll presses. These presses have rollers with pocketed surfaces to shape the material. Because of the high pressures, it is necessary to have some clearance between the rolls, but the briquettes are then formed with interconnected ligaments or lands of material between the individual pillows. This results in a briquette sheet which must be broken into its individual members. Especially when compacting iron ore or reduced iron ore, separation of the sheet with string breakers has been a problem; this is described in U.S. Pat. No. 3,593,378 and U.S. Pat. No. 3,300,815.

The briquettes from reduced iron ore are used in direct reduction processes. Commonly, iron ore is heated to about 1500° to 1900° F and formed into briquettes under roll pressures of 50 to 350 tons. In some cases, the iron ore is treated in a fluidized bed to remove about 5% of its oxygen, then it is briquetted for use in direct reduction processes; this is described in more detail in "The Making, Shaping and Treating of Steel", H.E. McGannon, ed, 9th ed, 1971, United States Steel Corporation, Pittsburgh, Pa., pp. 218–228, 403–421. In such processes, it is particularly important that the briquettes have smooth, complete shapes with a minimum of broken sizes and irregular jagged edges.

OBJECTS OF THE INVENTION

This invention concerns briquetting of loose materials and has the following objects.

A method and an apparatus for briquetting in which sheets of briquettes are separated into individual members; to have such a method in which a single step is sufficient to cause such separation; to utilize such a method particularly with loose materials that contain iron ore especially when such briquettes are used in direct reduction of iron. These objects include briquetting apparatus having improved means for separating sheets of briquettes into individual members providing in the apparatus, such means that will deliver impact forces to opposing sides of the briquette sheets and at spaced apart positions on said sheet and which means is self-cleaning and jam-free in operation.

SUMMARY OF INVENTION AND DRAWINGS

These and other objects are achieved by methods and apparatus that provide for forming sheets of briquettes, then applying impact forces to opposite sides of the sheet and then continuing the application of forces across the thickness of the sheet. This causes each briquette to simultaneously separate from its neighbors.

FIG. 1 illustrates a briquetting apparatus according to this invention.

FIG. 3 illustrates a briquette sheet as formed by the apparatus in FIG. 1.

FIG. 4 is a view of this sheet showing the profile of briquettes.

DESCRIPTION OF THE INVENTION

Figure 2:
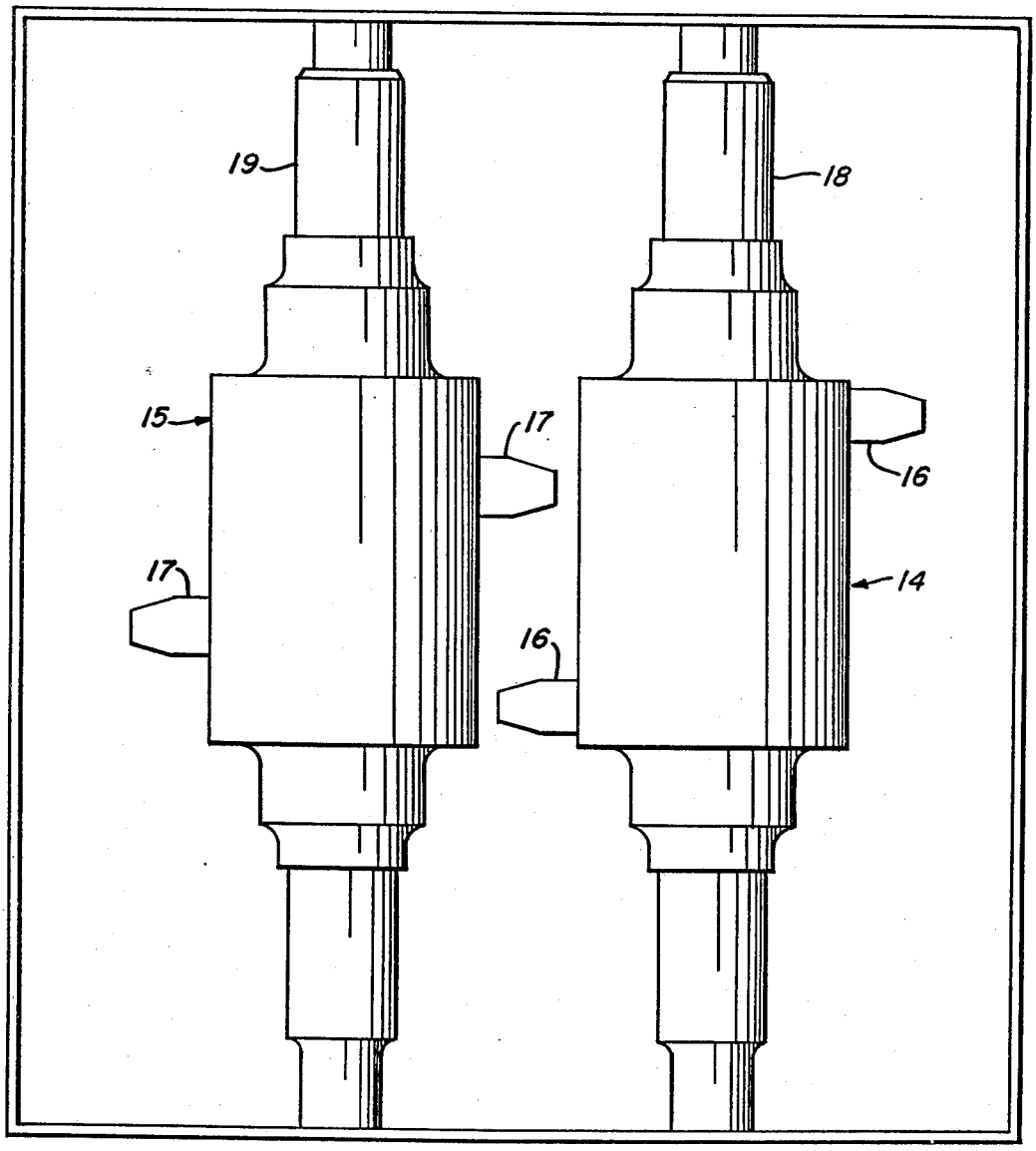
FIG. 2 is a sectional view of the apparatus of FIG. 1.

In the practice of the invention, loose material is formed into sheets of briquettes by feeding the material to roll presses. After the sheet exits from the roll presses, it is subjected to impact devices which creates impact forces on opposing sides of the sheet and wherein the opposed impact devices are positioned into parallel overlapping relationship with each other at the plane of the sheet exit and spaced from each other a distance corresponding to the distance between parallel briquette pockets in the briquetting machine. The impact forces are applied to separate briquettes on opposing sides at different points of the sheet. One force is applied to one briquette, while the force from the opposite direction is applied to another parallel briquette. By applying these forces to the briquettes, there is a large moment created at the interconnecting webs, this tends to give a clean sharp break along the leading edge of the briquette and may even completely break away the briquette. The continued extension of the forces across the sheet width will cause the broken briquettes to be removed or partially broken briquettes to bend sharply away from the sheet and complete the tearing around the periphery of the briquette. These broken briquettes are then removed by the motion of the impacting devices.

After the briquette is broken out from the sheet, it is then sent to a tumbler device, a trommel, where its sharp edges are removed. The smooth surfaced briquette then may be used in a furnace.

Loose material suitable for the practice of this invention may be any of the types commonly briquetted: minerals, ores, carbons, fines, flue dusts, etc. Iron ore fines and reduced iron ore fines are of particular interest for briquetting at temperatures above about 1400° F. With hot reactive materials, such as hot iron fines, carbon or char fines, an inert atmosphere, e.g. $N_2$, is desirable for briquetting.

Roll presses may have from about 20 to about 350 tons of pressure for shaping the loose material in the D-shaped roll pockets. There may be 1, 2, 3, 4 or more pockets across the roll surface. Each pocket is offset from its adjacent pocket by about one-half the length of the pocket. Next adjacent pockets are parallel to each other.

As the sheet of D-shaped briquettes leaves the press rolls, the impact forces are applied simultaneously to opposite sides of the sheet. When there are next adjacent briquettes, these forces are applied to these briquettes. One briquette receiving the impact upon the convex portion of the D, the other receiving the impact upon the flat side of the D. The impact will sever the web surrounding the briquettes. As the forces are continually applied, the briquette is pushed through and away from the sheet, resulting in the briquette being broken away from the sheet. The distance between the points of force application allow the broken out briquette to fall away. As the sheet advances, the successive forces may be applied to briquettes on alternate sides of the sheet center line. This improves a clean separation of the briquettes one from another and from the sheet.

Applying forces in this manner causes the simultaneous separation of a briquette from its strand and from its row in the sheet. FIG. 3 illustrates a sheet as it advances through the zone of force application. After the leading parallel briquettes are broken away, the adjacent briquettes are left with only the part of its surrounding web intact. As these briquettes are broken away, the succeeding briquettes likewise have only a partial web left, which connects them to the sheet.

The forces may be applied to the region from the center of the D-shape (top dead center) to the trailing edge of the briquette in the sheet. If the point of application is rearward of top dead center, then there is an additional forward thrust to break the briquette from the sheet.

The minimum force necessary to break the briquette from the sheet depends upon the nature of the material and the thickness of the web. With iron ore or partially reduced iron ore, the loose material is preferably at temperatures in excess of 1000° F, particularly 1500°–2000° F, because this gives improved briquette strength and the sheet is weaker than at lower temperatures. High temperature impact sampling of the particular sheet material will indicate the necessary minimum force to be used.

A briquetting apparatus according to the invention is illustrated in FIGS. 1 and 2. Loose material is fed to the briquetting machine 1. The press rolls 11 convert it into a sheet of briquettes 12. As shown in FIG. 3, the sheet 12 has briquettes 30 connected to each other by lands 31. This shows the spacing of adjacent and next adjacent briquettes. The D-shaped briquettes are shown in FIG. 4 in profile. The web formed by the lands 31 may be about 0.1 to 0.3 inch thick. The briquettes may be about 1 to 3 inches in length, about 0.5 to 1 inch thick and about 0.5 to 1 inch wide. The briquette sizes are selected according to the ultimate intended use. For iron or iron ore briquettes, lengths of about 1 inch are preferred.

The sheet of briquettes 12 then enters between opposing impact devices here shown as having shafts 18 and 19 to support cylinders 14 and 15 with impact means 16 and 17 mounted thereon, said support cylinders being axially aligned with the length of the sheet exit. Here, the impact means are shown as solid members attached to the cylinder support. The impact face of the member is chamferred on its sides and may be hardened. As shown in FIG. 2, the opposing impact devices have their impact means disposed to contact next adjacent briquettes in the sheet. On each of the devices, successive impact means are staggered from each other so that as the impact device moves, the impact forces can be applied on alternate sides of the briquette sheet centerline.

In the practice of this invention, the impact devices must be sufficiently rugged to withstand the impact force generated when the impact means strike the briquette sheet. Moreover, the devices are exposed to high temperature during the briquetting operation. An impact device in the form of a cylinder having mounted thereon impact means in the form of solid members will operate satisfactorily under these conditions. The impact means may be round or polygonal in cross-section, especially oval or rectangular. Other forms of the impact device include stationary frames with reciprocating drives to propel impact means in the form of solid shafts transversely to the direction of the briquette sheet. For all of the impact devices, the clearances and sequence of operation of the impact means are such that the simultaneous impact forces are applied on opposite sides of the briquette sheet.

The impact means are spaced from each other and move at a rate determined by the speed of the briquette sheet. The impact means when normal to the sheet extend across the thickness of the briquette sheet. The spacing of the impact means on opposing impact devices provides clearance for discharge of briquettes broken away from the sheet. The staggered arrangement of impact means on an impact device permit the machine to be self-cleaning. If briquettes or pieces of briquette sheets fall into the space between impact means, the motion of the succeeding impact means will tend to clear the spacing.

On each impact device, the impact means are coordinated with the impact means of the opposite device so that when the sheet is struck, the impact forces are delivered on parallel next adjacent briquettes. If there are two such briquettes, each device will have one impact means contacting the sheet at the same time. If there are more than two such briquettes, then the total number of impact means striking the sheet will be equal to the sum of this number. The means on each device will still be disposed to deliver forces on opposite sides of the sheet to parallel next adjacent briquettes.

A housing 13 encloses the impact means of the briquetting machine. This housing may be used to enclose an inert atmosphere such as nitrogen when materials reactive at the briquetting temperatures are processed.

A specific illustration of this invention is as follows:

Iron ore is treated to remove at least about 75% of its oxides and transferred at a temperature of about 1600° F to a pair of briquetting roll presses. These rolls form a sheet having four briquettes across its width. These briquettes are about 1 inch in length, 0.5 inch wide and 0.5 inch radius. About 33 briquette rows per second are made. The briquette sheet has a web thickness of about 0.1 inch. This sheet travels at a speed of about 53 inches per second. The sheet is passed between opposing cylinders. The cylinders have a diameter of about 10 inches and are centered on opposite sides of the sheet and having the axes of the cylinders lying in the same plane and positioned about 15 inches apart. Under the aforesaid circumstances these cylinders are driven by external motors at a speed of 671 rpm. This speed may vary from about 250 to 750 rpm depending upon the briquette sheet speed and the number of impact means. There are six steel pins mounted equi-distant about the periphery of each cylinder. These pins are rectangular in cross section at about 2 inches on a side. These pins are about 3 inches in height, having chamferred sides adjacent the outer face. The face is about 1 inch on each side. These pins are staggered from each other along the periphery. On the one cylinder, these pins are aligned adjacent each other on each side of the sheet centerline. On the opposing cylinder, these pins are staggered so that they contact the briquettes along the outside edge of the briquette sheet, i.e. their centerlines are about 5.5 inches apart measured across the cylinder. When the pins of opposing cylinders are parallel to each other and normal to the plane of the sheet, the faces will extend about 0.4 inch beyond the mid-section of the sheet. The cylinders are rotated upon their shafts and the impact face of the pins first contact the briquettes at about top dead center. Separated briquettes fall onto the conveyor which carries them to a tumbler where residual sharp edges are removed.

A particular advantage of this invention is that broken pieces of briquette sheet will pass through the impacting devices without causing jamming of the devices. Usually, the broken sheet is of sufficient size to be engaged by the impacting devices where the action of the impacting forces will break it into its separate briquettes. Moreover, if the sheet of briquettes as it issues from the press rolls, tends to curve away from a straight path, the opposed impact devices will align it to be subject to the impact forces whose motion will break out the briquettes. Where portions of sheet have fallen past the impact devices without breaking, they may be recycled directly to the impacting devices via conveyors and chutes which will align these sheets and feed them directly into the impacting devices for briquette separation.

While our invention has been described in terms of specific components, materials and steps, variations and additions in structure or procedure as would be apparent to one skilled in the art are equally within the spirit of our invention.

We claim:

1. In a process for forming briquettes, the steps comprising:

a. compressing a loose material under a pressure of about 20 to about 350 tons with roller presses into a continuous sheet of briquettes, said sheet having a plurality of briquettes arranged in rows across the width of the sheet, b. adjacent to the sheet exit from said presses, applying to said sheet a plurality of impact forces alternately disposed on opposite sides of said sheet, the impact forces being alternately applied to each separate briquette, the application of said forces being continued for a sufficient time to penetrate said sheet and simultaneously separate individual briquettes from adjacent members in its row and from members in adjacent rows, and c: collecting and conveying said separated briquettes.

2. The process of claim 1 wherein said impact forces are applied at the rearward portion of said briquettes in the sheet.

3. The process of claim 1 wherein said impact forces are applied by disposing impact devices adjacent to said sheet, said impact devices including a cylindrical support and impact means rigidly attached to said support, said devices rotating parallel to the direction of said sheet.

4. The process of claim 1 wherein said loose material contains iron ore.

5. The process of claim 1 wherein said loose material contains iron ore and iron.

6. The process of claim 1 wherein said loose material is a partially reduced iron ore.

7. The process of claim 6 including the additional step of recovering portions of briquette sheets from broken and separated briquettes and recycling these portions directly to step b).

* * * * *